United States Patent [19]

Sternberg

[11] 4,238,868

[45] Dec. 16, 1980

[54] REFUSE BAG HOLDER

[76] Inventor: Gerd Sternberg, 6785 W. Garden Grove, Las Vegas, Nev. 89103

[21] Appl. No.: 34,398

[22] Filed: Apr. 30, 1979

[51] Int. Cl.[3] ..... A47F 13/08

[52] U.S. Cl. ..... 15/257.4; 248/101; 248/224.3

[58] Field of Search ..... 15/257 R, 257.1, 257.4; 248/101, 224.3

[56] References Cited

U.S. PATENT DOCUMENTS

| | | | |
|---|---|---|---|
| 440,618 | 11/1890 | Byers | 15/257.4 |
| 445,195 | 1/1891 | Pendery | 248/101 |
| 1,664,658 | 4/1928 | Blazer | 248/101 X |
| 3,253,812 | 5/1966 | Okazaki | 248/101 X |
| 3,870,261 | 3/1975 | McSwain | 248/101 |
| 3,893,649 | 7/1975 | Cornell et al. | 248/101 X |

*Primary Examiner*—Robert L. Bleutge
*Attorney, Agent, or Firm*—Seiler & Quirk

[57] ABSTRACT

A device for holding a flexible plastic refuse bag comprises a continuous rectangular bag-supporting loop and a coextensive annular clamping frame which snaps in place over the loop, gripping the bag in place. A flat scoop is attached to the clamping frame, and a handle on the opposite side from the scoop enables easy manipulation of the device. A mounting sleeve receives the handle for wall-mounting.

7 Claims, 4 Drawing Figures

REFUSE BAG HOLDER

BACKGROUND OF THE INVENTION

This invention relates to an improved device for supporting a plastic refuse bag with the open end thereof maintained in an open orientation. The device consists of a substantially continuous bag-supporting member which holds the bag in open position, and a substantially coextensive clamping frame which engages the bag support member, frictionally grasping the circumference of the bag therebetween. A flat scoop integral with the clamping frame permits use of the bag holder to scoop or shovel material directly into the bag. A handle located at the rear of the bag holder enables a user to manipulate the holder by hand, and also serves as a wall or cart mounting means. A removable lid for the bag holder is also provided.

Numerous different devices for retaining a disposable plastic refuse bag in an open position are well known. Over 60 years ago, Oldham, U.S. Pat. No. 1,266,522, disclosed a street cleaning utensil havine a Y-shaped bag support carrying a plurality of hooks for bag attachment. Apparatus having a very similar appearance to the Oldham device, but showing different mechanisms for clamping the bag to the frame, is disclosed in Anderson, U.S. Pat. No. 3,754,785.

A bag holder having a simple rectangular frame which frictionally retains the open bag mouth, and having a hinged lid, is shown in Levy, U.S. Pat. No. 3,149,809. The bag is frictionally retained on the frame by proper dimensioning of the frame such that when the bag is threaded through the inside of the frame and over the upper rim thereof, a tight frictional fit is obtained. In addition, refuse bag holders having hinge-mounted clamping frames to secure the bag in place are disclosed in Ballenger, U.S. Pat. No. 3,679,160, and McSwain, U.S. Pat. No. 3,870,261. In the Ballenger patent, a support frame is pivotally mounted on a stake, and is used to hold the bag by wrapping the edges of the bag opening around the support frame. The hinged cover is apparently not used as a frictional clamping device. The McSwain patent shows a bag support apparatus having a support ring, and separately hinged clamping frame and lid. The support ring and clamping frame are designed with cross-sections providing two frictional engaging points on opposite sides of the support ring for frictionally retaining the bag when the ring and frame are engaged.

It is an object of the invention to provide a refuse bag-support device which is very easy and inexpensive to manufacture, yet which has multiple uses and capabilities. It is a further object of the invention to provide a refuse bag holder which is quickly and easily assembled and disassembled, and which will not tear or otherwise damage a plastic refuse bag while in use. It is yet a further object of the invention to provide a refuse bag holder which may be hand held or wall or cart mounted, and which has an integral flat scoop which may be used to guide materials such as leaves into the bag. These and other objects of the invention will be apparent from the following detailed description of a preferred embodiment of the invention.

SUMMARY OF THE INVENTION

A refuse bag holder comprises a substantially continuous tubular bag-support member adapted to receive the circumference of a flexible refuse bag, an annular tubular clamping frame having a slot along the bottom portion thereof adapted to forcibly receive the bag support member, the cross-section of the bag-support member being of similar shape and slightly smaller size than the clamping frame, handle means for supporting the bag holder, and a flat, rigid scoop attached to the clamping frame.

BRIEF DESCRIPTION OF THE DRAWINGS

The invention is best understood with reference to the drawings, in which.

DETAILED DESCRIPTION OF THE INVENTION

Figure 1:
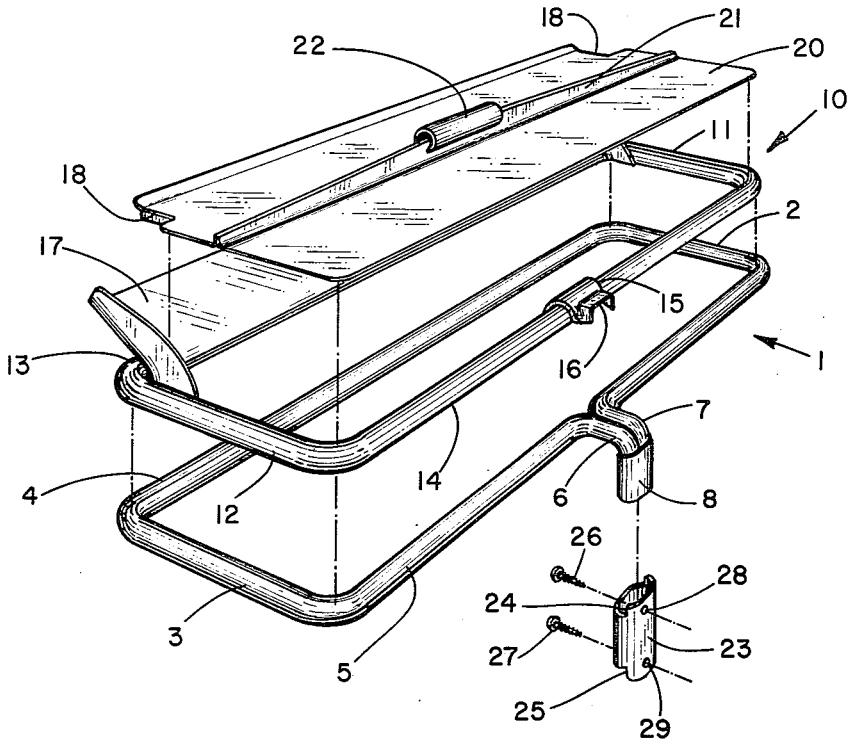
FIG. 1 is an exploded view of the bag holder, showing the wall mount, bag support member, clamping frame, and lid in spaced relationship.

Referring to FIG. 1, the bag holder of the invention comprises a bag-supporting member 1, a substantially coextensive clamping frame 10, and a removable lid 20. The bag-supporting member is a rectangular loop having outside dimensions of about $9\frac{1}{2}'' \times 18\frac{1}{2}''$ having end portions 2 and 3 and side portions 4 and 5. The loop is fabricated from a single piece of plastic pipe, e.g., PVC pipe, by forming a series of right angle bends in the pipe with the application of heat at the bends. At the rear of the bag-supporting member, the ends of the pipe 6 and 7 are bent outwardly in a horizontal plane and downwardly in a vertical plane to form a cantilevered handle. A thin, flexible piece of PVC sheet 8 is wrapped around the ends of the pipe and glued in place to hold the ends of the pipe together and to form a smooth gripping surface.

Figure 2:
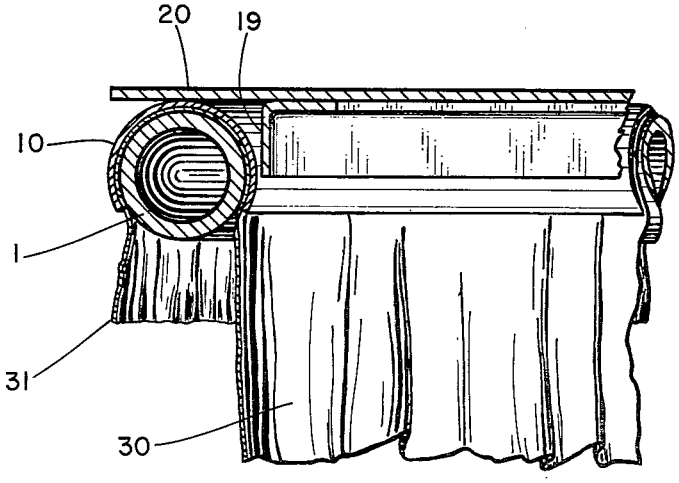
FIG. 2 is a partial cross-sectional view showing a bag in place in the bag holder.

The clamping frame is an annular ring substantially coextensive with the bag-supporting member which is formed from a plastic pipe having a circular cross-section having a longitudinal slot cut uniformly along the bottom thereof. In operation, a flexible refuse bag 30 is threaded from the inside of the bag-supporting member 1, over the top thereof and down along the outer surface thereof as shown in FIG. 2. The clamping frame 10 is pressed downwardly over the bag and the bag-supporting frame, frictionally holding the bag in place.

The clamping frame is fabricated from a relatively thin, flexible plastic pipe, such as Schedule $120\frac{3}{4}''$ PVC pipe. The relative sizes of the pipe used to manufacture the bag-support member and the clamping frame are such that the inside diameter of the clamping frame is substantially the same as the outside diameter of the bag supporting member. The term "substantially the same" is intended to include diameter variations of less than 1/4", and preferably less than 1/8". For example, the inside diameter of the clamping frame may be about 1/8" larger or 1/8" smaller than the outside diameter of support member 1. Permissible variations will also be determined by the flexibility and strength of the clamping frame, and the circumferential width of the slot. For example, if the inside diameter of the clamping frame is slightly less than the outside diameter of the bag-supporting member, a slot having a circumferential width of 180° or slightly less is adequate for maintaining a frictional grip on member 1. In this case, the larger bag-support member enters the slot and forces the cross-section of the clamping frame to spread open, creating a natural inward bias caused by the resiliency of the plastic, and thereby gripping the pipe.

The clamping frame 10 is a substantially continuous member having end portions 11 and 12, front portion 13, and rear portion 14 corresponding to portions 2, 3, 4, and 5 of the bag-supporting loop, respectively. The ends of the clamping frame are secured by a semi-circular clip 15 having a raised flange 16 to fit over handle members 6 and 7 when the clamping frame is positioned over the bag-support member. A flat scoop 17 extends upwardly and outwardly from the front portion of the clamping frame. While the bag holder itself may be of any shape, e.g., round, it is shown as rectangular primarily to permit the construction of an integral flat scoop. Since the scoop extends the full width of the bag holder, and since the blade is straight and flat, the bag holder may easily be used to scoop up leaves or other refuse in large quantities. The flat construction of the scoop precludes material to be gathered from escaping between the scoop and the ground. The particular dimensions of the bag holder, with the width being substantially greater than the front-to-back depth of the device, ensures that a maximum quantity of refuse may be picked up with each motion of the scoop.

Figure 3:
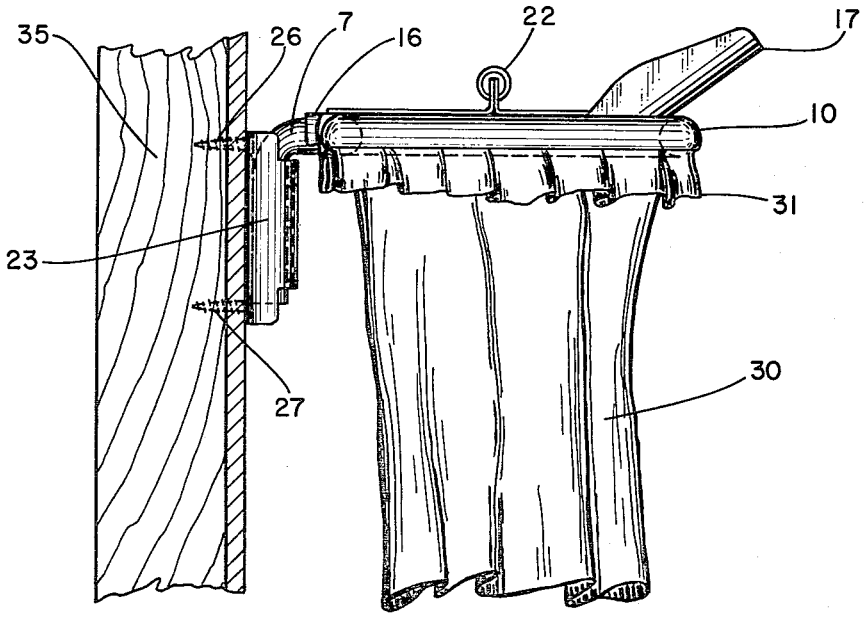
FIG. 3 is a side elevational view showing the unit mounted on a wall.

When used to scoop up refuse from the ground or floor, a bag is threaded through the bag-supporting member and secured with the clamping frame. The user then grasps the handle 8 and slides the scoop along the surface to collect the refuse. When used as a garbage bag into which refuse is periodically placed, the unit may be mounted on a wall by means of mounting bracket 23. The mounting bracket is a hollow sleeve adapted to receive handle 8 having cutaway front portions 24 and 25 to expose screw receiving bores 28 and 29 in the rear portion thereof and to prevent sidewards movement of the bag-supporting member. FIG. 3 shows the unit mounted on wall 35 by means of screws 26 and 27.

Figure 4:
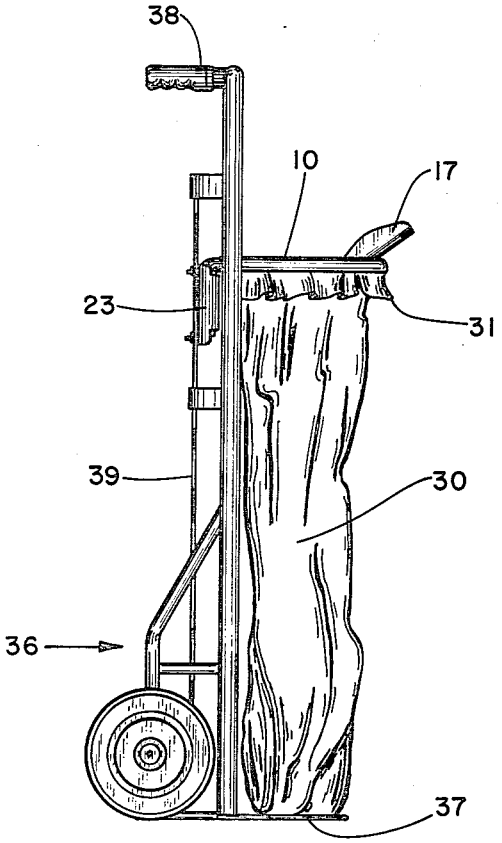
FIG. 4 is a side elevational view showing the bag holder mounted on a cart.

The unit may also be mounted elsewhere, such as on a pushcart as shown in FIG. 4. Mounting bracket 23 is shown secured to vertical frame member 39 of pushcart 36 by means of nuts and bolts. The device is also easily mounted for use on a restaurant bus cart. The bottom of bag 30 rests on horizontal frame base 37, thus providing additional support for any heavy materials which are contained within the bag. A user may then wheel the pushcart from location to location using handle 38, easily collecting refuse at a variety of locations.

The slidable fit of the handle of the bag holder into the mount is quite important in permitting the holder to be rapidly removed from a wall or cart and replaced thereon. The mounting member need not carry substantial weight, since it is generally positioned at a height such that the bottom of the bag rests on the floor or on the cart base (see FIG. 4) rather than being carried by the bag holder.

A flat lid 20 is provided to cover the bag opening to prevent odors from escaping from the receptacle, and to prevent animals from access to the bag contents. The lid consists of a generally rectangular flat member having a pair of indentations 18 on either side of the front portion thereof to fit inside the side portions of scoop 17. A vertical flange 21 carries a round handle 22 which is used for placing and removing the lid. A peripheral angle member 19 (see FIG. 2) has a horizontal flange attached to the underside of the lid and a vertical flange extending downwardly at a location generally adjacent to the inner side of clamping frame 10. The angle member serves as a guide to maintain the proper relationship of the lid and the clamping frame, and also effects a seal therebetween.

Round cross-sections for the bag-supporting member and the clamping frame are preferred since they provide the maximum surface area contact between the members, and also provide excellent gripping capability. If the bag is gripped only at specific locations around the periphery of the bag-supporting loop, tears may occur in the bag, particularly when heavy items are carried therein. When the clamping frame is snapped in place over the bag supporting loop, the entire structure has great strength and stability, and cannot accidentally come apart during vigorous use, e.g., for scooping refuse. In addition, the tight frictional grip afforded by this design precludes slippage of the bag through the frame even when very heavy materials are carried in the bag.

Plastic piping, such as PVC, ABS, or the like, is a preferred material of construction because it is inexpensive and easily worked. In bending the pipe, the pipe is filled with an incompressible material, such as sand, and is then heated in an oven or with a torch. With moderate heat, the pipe may be easily bent into the desired shape. The particular method of manufacture should not be considered as limiting the invention, however; commercially, the members are easily fabricated by injection molding. In addition to these advantages, the plastic pipe used to form the clamping frame is sufficiently flexible to permit insertion and removal of the bag-supporting pipe, and yet is sufficiently resilient to effect a strong gripping action when the clamping frame is in place. Since all of the parts are made from PVC, they may easily be glued by conventional means where joints are required.

Refuse bag holders of the invention have been successfully fabricated using ½" Schedule 40 PVC pipe having an inside diameter of 5/8" and an outside diameter of about 7/8" for the bag-supporting member, and ¾" Schedule 120 PVC pipe having an outside diameter of about 1.05" and an inside diameter of about 0.95" for the clamping frame. The slot in the clamping frame should be of sufficient width to permit the frame to be easily removed but to maintain a firm grip when in place. In general, the integral portion of the cross-section of the clamping frame should extend from about 170° to about 240° (corresponding to a slot of 120°–190°), preferably from about 180° to about 225°. Effective gripping can be obtained with a circumference of 170° only if the inside diameter of the clamping member is smaller than the outside diameter of the bag-supporting member. Small slots leaving a circumference of greater than 240° generally require clamping frame material to be too resilient to obtain a good frictional fit with the bag-supporting loop.

Use of the bag holder of the invention is quite simple. The user extends the edge 31 of the bag opening through the inside of the bag supporting loop, over the top thereof, and downwardly around the outside as shown in FIG. 2. The clamping frame is pressed over the bag, engaging the support loop and locking the bag in place. The user then can grasp the handle with his hand, and manually scoop up large quantities of refuse very quickly. When the bag is filled, the clamping frame is removed by lifting it straight upwardly from the support loop, freeing the bag for closing.

Other modifications and additions may be made to the refuse bag holder of the invention within the spirit and scope of the invention. For example, one or more small handles may be added to the upper portion of the clamping frame for ease in gripping the frame when removing it from the bag-supporting member. Accordingly, the scope of the invention should not be considered limited by the foregoing description of the preferred embodiment thereof, but should rather be defined only by the following claims.

I claim:

1. A refuse bag holder for supporting disposable plastic refuse bags comprises a rigid rectangular bag-supporting loop, an annular clamping frame having a slot along the bottom portion thereof, said slot dimensioned to forcibly receive the bag-supporting loop, the cross-section of the bag-supporting loop being of similar shape to the cross-section of the clamping frame such that a refuse bag clamped therebetween is frictionally retained in place, and a flat, rigid scoop extending outwardly from the clamping frame, and handle means located on a side of the refuse bag holder opposite the scoop, said handle means also comprising mounting means for removably attaching the refuse bag holder to a structure.

2. The refuse bag holder of claim 1 wherein the bag-supporting loop and the clamping frame have circular cross-sections.

3. The refuse bag holder of claim 1 wherein the scoop has a base portion attached to and substantially coextensive with one side of the refuse bag holder.

4. The refuse bag holder of claim 1 also comprising mounting means for mounting the refuse bag holder in a substantially horizontal position, said mounting means comprising a sleeve adapted to slidably receive the handle means, and means for attaching the sleeve to a substantially vertical surface.

5. The refuse bag holder of claim 1 wherein the inside diameter of the clamping frame is substantially the same as the outside diameter of the bag-supporting loop.

6. The refuse bag holder of claim 1 wherein the slot comprises a circumferential opening of from about 120° to about 190°.

7. The refuse bag holder of claim 1 wherein the slot comprises a circumferential opening of from about 135° to about 180°.

* * * * *